US009761985B1

(12) United States Patent
Peng

(10) Patent No.: US 9,761,985 B1
(45) Date of Patent: Sep. 12, 2017

(54) SOCKET WITH SAFETY PROTECTION EFFECT

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 15/364,339

(22) Filed: Nov. 30, 2016

(51) Int. Cl.
*H01R 13/44* (2006.01)
*H01R 13/512* (2006.01)
*H01R 13/631* (2006.01)

(52) U.S. Cl.
CPC ..... *H01R 13/44* (2013.01); *H01R 13/512* (2013.01); *H01R 13/631* (2013.01)

(58) Field of Classification Search
CPC ..... H01R 13/44; H01R 13/512; H01R 13/631
USPC ..... 439/188, 37
See application file for complete search history.

(56) References Cited

U.S. PATENT DOCUMENTS 4,136,919 A * 1/1979 Howard ..... H01R 13/20 439/346
4,230,386 A * 10/1980 Farnworth ..... H01R 13/7036 439/188
4,283,102 A * 8/1981 Richier ..... H01R 13/7036 439/140
4,544,219 A * 10/1985 Barkas ..... H01R 13/4534 439/137
4,722,693 A * 2/1988 Rose ..... H01R 13/4534 439/137
4,932,886 A * 6/1990 Glaser ..... H01R 13/7036 439/137
5,112,237 A * 5/1992 Yang ..... H01R 13/20 200/317
6,406,308 B1 * 6/2002 Wang ..... H01R 13/4534 439/145
6,776,630 B1 * 8/2004 Huang ..... H01R 13/4534 439/137
7,052,308 B2 * 5/2006 Drane ..... H01R 13/506 439/417
7,510,412 B1 * 3/2009 Valentin ..... H01R 13/4534 439/137
7,645,149 B2 * 1/2010 Carbone ..... H01R 13/4534 439/137
7,651,347 B2 * 1/2010 Germain ..... H01R 13/4534 439/137
7,820,909 B2 * 10/2010 Castaldo ..... H01R 13/4534 174/53
7,914,307 B1 * 3/2011 Yang ..... H01R 13/4534 439/137

(Continued)

*Primary Examiner* — Alexander Gilman
(74) *Attorney, Agent, or Firm* — Alan D. Kamrath; Kamrath IP Lawfirm, P.A.

(57) ABSTRACT

Disclosed is a socket with a safety protection effect formed by installing a safety element and a protection door module in the socket to provide the safety protection effect. The protection door module has a first protective plate and a second protective plate disposed on two through slots of the safety element respectively. When a user inserts a strip member into any one of the electrically connected jacks formed on the socket panel, the first protective plate and the second protective plate restrict one another to cover the corresponsive through slots, so that the strip member will not touch the conductive chip inside the socket to prevent the risk of electrical shocks.

6 Claims, 8 Drawing Sheets

(56) References Cited

U.S. PATENT DOCUMENTS 8,007,296 B2 * 8/2011 Chen ..... H01R 13/4534 439/136
8,062,072 B2 * 11/2011 Ziobro ..... F21S 6/003 439/650
8,100,705 B2 * 1/2012 Chen ..... H01R 13/4534 439/137
8,147,260 B2 * 4/2012 Huang ..... H01R 13/4534 439/140
8,152,544 B1 * 4/2012 Hung ..... H01H 13/12 439/188
8,435,055 B1 * 5/2013 Bhosale ..... H01R 13/4534 439/145
8,480,415 B2 * 7/2013 Byrne ..... H01R 13/52 439/106
8,562,362 B2 * 10/2013 Jiang ..... H01R 13/4534 439/137
8,834,186 B2 * 9/2014 Lo ..... H01R 13/4534 439/140
9,059,529 B1 * 6/2015 Lai ..... H01R 13/44
9,059,530 B2 * 6/2015 Byrne ..... H01R 13/4534
9,543,715 B2 * 1/2017 Savicki, Jr. ..... H01R 25/006
2009/0311892 A1 * 12/2009 Weeks ..... H01R 13/4534 439/137
2010/0041259 A1 * 2/2010 Ni ..... H01R 13/4534 439/137
2013/0171847 A1 * 7/2013 Huang ..... H01R 13/4534 439/137
2013/0189864 A1 * 7/2013 Chen ..... H01R 13/453 439/136
2014/0051287 A1 * 2/2014 Liao ..... H01R 13/4534 439/607.01
2015/0380856 A1 * 12/2015 Mortun ..... H01R 13/4534 439/138
2016/0013577 A1 * 1/2016 Diakomis ..... H01R 13/4536 439/138
2016/0087368 A1 * 3/2016 Bazayev ..... H01R 13/4534 439/93
2016/0087369 A1 * 3/2016 Bazayev ..... H01R 13/4534 439/100

* cited by examiner

SOCKET WITH SAFETY PROTECTION EFFECT

BACKGROUND OF THE INVENTION

Field of the Invention

The present invention relates to a socket with a safety protection effect, and more particularly to the socket having a safety element and a protection door module installed therein to provide a safety protection effect, such that when a user intentionally or unintentionally inserts a strip member into any one hole of the socket jacks, the safety protection effect jointly achieved by the safety element and the protection door module can block the insertion of the strip member to prevent the user from having the risk of an electrical shock.

Description of the Related Art

As electric power has been used extensively in our daily life, various different electrical products such as refrigerators, fans, washing machines, lamps, computers, etc are turned on by electric power to enrich our life. In general, the use of electric power is to directly insert two or three pins of a plug of an electric wire of the electrical products into a jack of a socket (such as a wall socket or an extension cord socket) to achieve the effect of connecting the electric power, so as to use the electrical products conveniently. Obviously, sockets are important, and a general conventional socket comprises: a casing, having a space therein for installing at least two conductive clips which are connected to naked wires of a power cord respectively and in turn connected to the mains power to conduct electric power; a panel, having at least two jacks disposed at the top, penetrating a panel, and configured to be corresponsive to the conductive clips, and the jacks being provided for inserting at least two pins of the plug on an one-to-one correspondence, so that the two pins and the two conductive clips are contacted and clamped with one another to conduct the electric power of the mains power transmitted by the power cable to the pins.

The aforementioned assembly and use of the conventional socket is well known and become a common daily experience. However, the conventional socket has the following drawback. The jack of the panel of the socket has an open path to the conductive clip, and thus curious children may hold and insert a strip member into any one of the two jacks of the socket easily, and the respective conductive chip is touched. If the strip member is electrically conductive, then the children will be electrically shocked and the circuit will be shorted. Such conducts are very dangerous and may jeopardize lift and result in accidents.

SUMMARY OF THE INVENTION

In view of the aforementioned drawback of the prior art, the inventor of the present invention conducted researches and experiments, and finally developed a socket with a safety protection effect in accordance with the present invention to overcome the drawback of the prior art.

Therefore, it is a primary objective of the present invention to provide a socket with a safety protection effect, wherein when a user intentionally or unintentionally inserts a strip member into any one of the holes of the jack electrically connected to the socket, a safety protection door module blocks the insertion of the strip member to prevent the strip member from touching the respective conductive clip, so as to prevent the danger of electrical shocks.

To achieve the aforementioned and other objectives, the present invention discloses a socket with a safety protection effect comprising a casing, a panel, a bottom plate, a safety element and a protection door module.

The casing comprises at least two containing grooves formed therein and vertically penetrated, and a first area and a second areas divided from a top panel at the top of the casing, and the first area is provided for the containing grooves to pass to the outside, and a second area has a through hole passing downwardly.

The panel is covered onto the top of the casing and comprises two electrically connected jacks communicated with the containing grooves of the casing respectively, and a vertical engaging peg extended downwardly from the bottom of the panel into the through hole of the casing.

The bottom plate has a set of conductive clips contained in the containing groove of the casing, and the set of conductive clips is coupled to a power cable connected to the mains power, and the bottom plate has a notch plug pluggable into an opening formed at the bottom of the through slot of the casing, and an engaging member passed through the notch plug and then engaged with the engaging peg of the panel.

The safety element has a base surface, a standing pole formed separately at both ends of the bottom of the safety element, a through slot vertically penetrated through each standing pole, an acting groove formed adjacent to the through hole of the safety element, and a large recess formed separately on both sides of one of the acting grooves.

The safety protection door module is comprised of a first protective plate, a second protective plate and an elastic member, and the first protective plate is a lump with a side defined as a pushing side and the other side having a rib, and a link rod extended out from an edge, whose end protruded upwardly is a stopper, so that when a containing groove is formed between the rib and the stopper, the bottom of the first protective plate becomes a rib; the second protective plate is another lump with an indentation formed on a side opposite to the first protective plate, and a side coupled to the first protective plate is a pushing side, and a link rod is extended from each edge and whose end is protruded to form a stopper, and a top block is formed at the bottom of the link rods, so that an outer end of the top block becomes a recess and an inner end of the top block is a containing groove, and when the rear end of the bottom of the second protective plate is formed into a rib and assembled, the top block of the second protective plate is accommodated in the containing groove of the first protective plate, so that the recess of the second protective plate slightly touches the rib of the first protective plate, and the stopper of the first protective plate is accommodated in the containing groove of the second protective plate, and an end of the elastic member is inserted and fixed into the indentation of the first protective plate.

When the whole socket is assembled, the bottom plate together with the conductive clip and the notch plug are attached to the bottom of the casing, so that the conductive clip enters into the containing groove of the casing, while the notch plug is plugging a lower notch of the through slot of the casing lower notch, and then the safety element is erected from the first area of the roof of the casing by the standing pole of the base surface, so that the through slots of the safety element are attached to the containing grooves of the casing respectively, and then the safety protection door module is covered onto the safety element, so that the pushing side of the first protective plate and the pushing side of the second protective plate are disposed at the top of the through slot of the safety element, and finally the panel is covered onto the top of the casing, so that the rear end of the elastic member abuts against an inner wall on a side of the panel, while the engaging peg of the panel enters into the through slot of the casing, and then the engaging member is passed through the notch plug and engaged with the engaging peg.

In the socket with a safety protection effect, the socket further comprises a positioning rod erected from an outer side of the containing groove in the first area of the casing, and a latch slot formed on the safety element, and the latch slot latches the positioning rod when the safety element is erected from the first area of the casing.

In the socket with a safety protection effect, the casing has a through hole formed at the middle of the through slot, and the panel has a corresponsive ground jack, and the bottom plate has an upwardly extended conductive plate, and the bottom section of the conductive plate is bent and extended downwardly and inwardly from the bottom of the bottom plate, and then locked together with a ground line to the bottom of the bottom plate by an engaging member.

In the socket with a safety protection effect, the casing has a latch plate coupled to a side of the casing, so that when the socket is accommodated in a reserved installation hole, the latch plate coupled to a side of the casing side and the wall of the installation hole are latched.

In the socket with a safety protection effect, the casing has a latching portion formed on a side of the casing, and the panel has a corresponsive latch rod for latching the latching portion.

In the socket with a safety protection effect, the elastic member is preferably a long-strip spring.

DETAILED DESCRIPTION OF THE PREFERRED EMBODIMENTS

Figure 1:
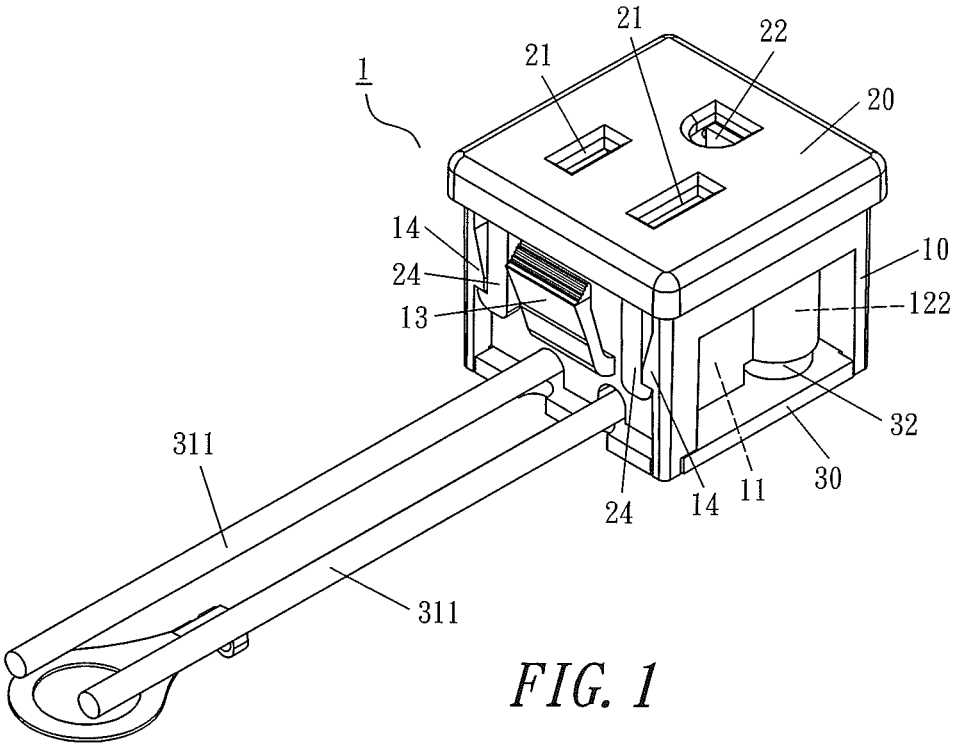
FIG. 1 is a top view of an embodiment of the present invention.

The technical characteristics, contents, advantages and effects of the present invention will be apparent with the detailed description of a preferred embodiment accompanied with related drawings as follows.

With reference to FIGS. 1 to 4 for a socket 1 in accordance with an embodiment of the present invention, the socket 1 comprises a casing 10, a panel 20, a bottom plate 30, a safety element 40 and a protection door module 50, wherein the casing 10, the panel 20 and the bottom plate 30 are exposed (as shown in the external appearance of the socket 1), and the safety element 40 and the protection door module 50 are installed inside the socket 1 (not shown in the external appearance of the socket 1).

Figure 3:
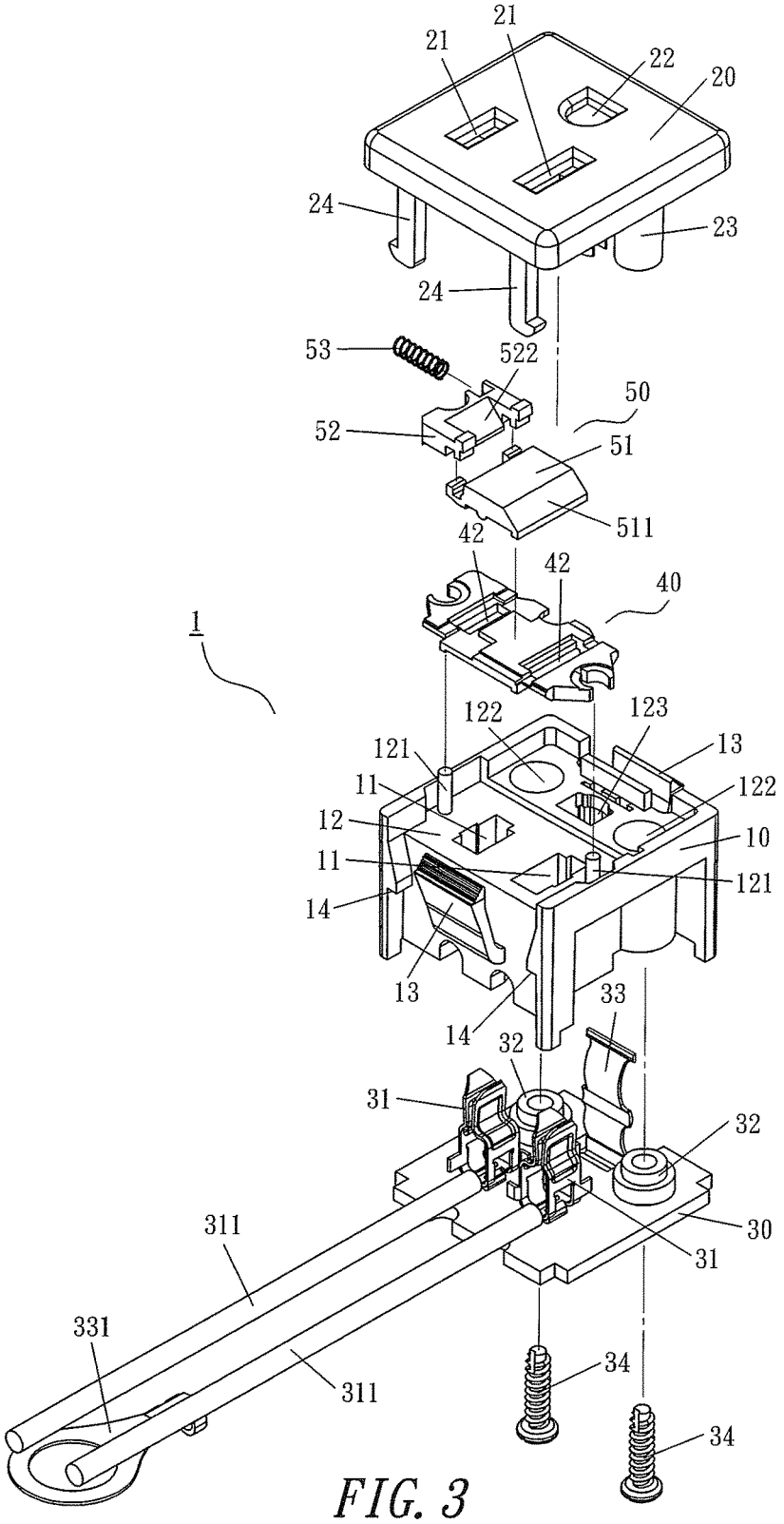
FIG. 3 is a top exploded view of an embodiment of the present invention.
Figure 4:
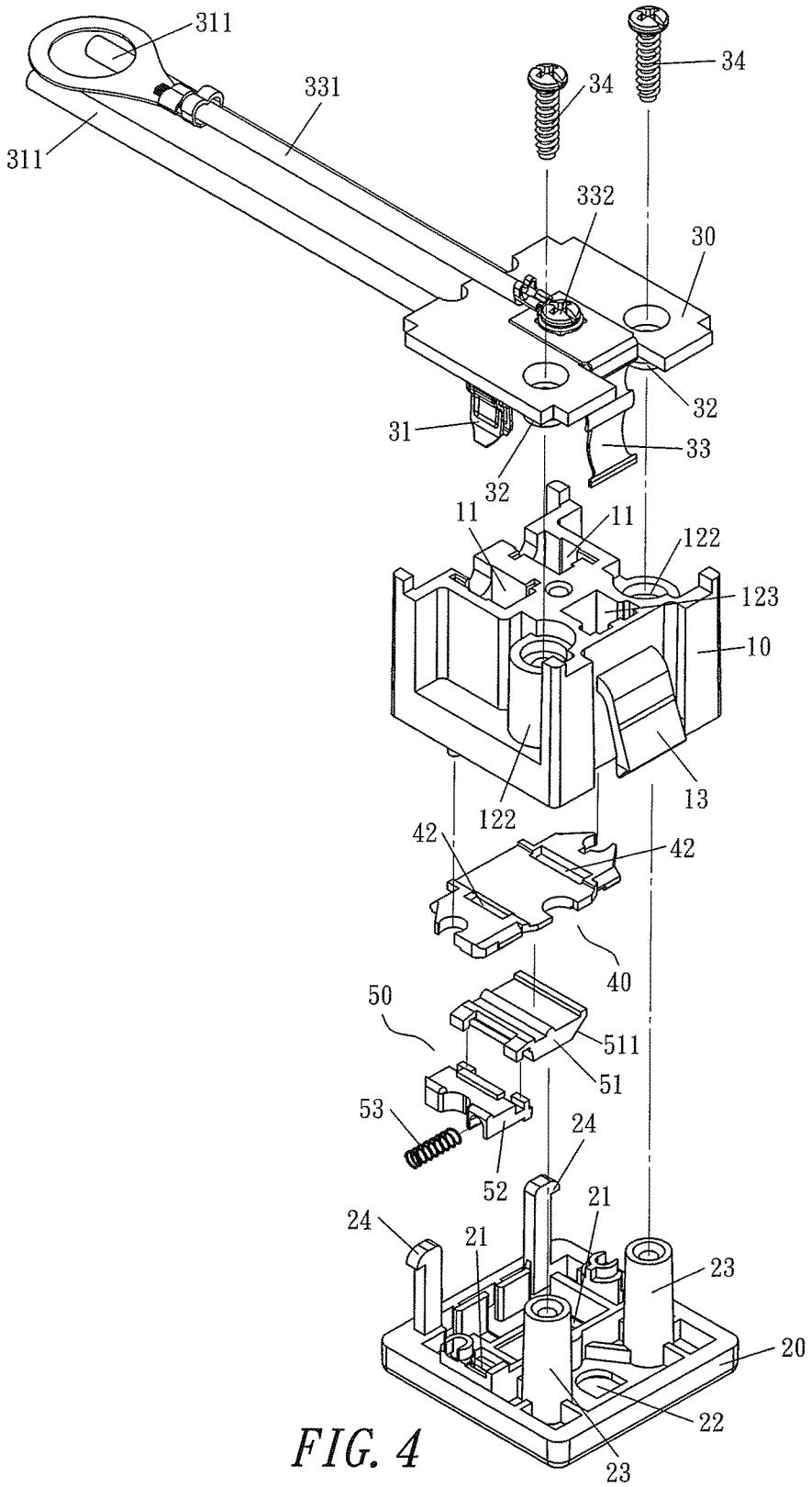
FIG. 4 is a bottom exploded view of an embodiment of the present invention.

The casing 10 has two containing grooves 11 formed therein and penetrated linearly (as shown in FIG. 4), a first area and a second area divided from a roof 12 of the casing 10, and the first area being provided for the containing grooves 11 to pass to the outside, and a positioning rod 121 being erected from an outer side of the two containing grooves 11, and the second area having two downwardly penetrated through slots 122 and a through hole 123 formed between the through slots 122, a latch plate 13 coupled to each of the front and rear sides of the casing 10, and a latching portion 14 formed on either one of the left and right sides (as shown in FIG. 3).

The panel 20 is covered completely onto the top of the casing 10, and the panel 20 has two electrically connected jacks 21 communicated with the containing grooves 11 respectively, and a ground jack 22 communicated with the through holes 123, and two engaging pegs 23 and two latch rods 24 are extended downwardly from the bottom of the panel 20, and the position and external diameter of the engaging pegs 23 are corresponsive to the through slot 122, so that the engaging pegs 23 can be precisely installed into the through slot 122; and the position and effect of the latch rod 24 are the same as the aforementioned latching portion 14 and capable of providing a secured latching effect for the installation (as shown in FIG. 1).

Figure 2:
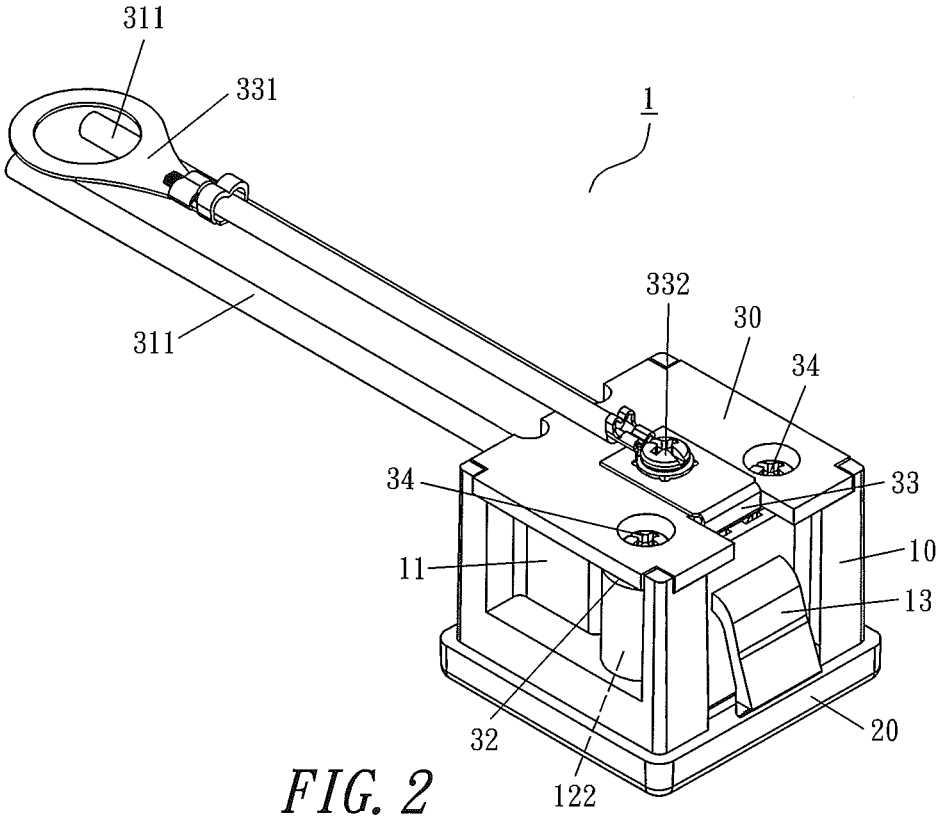
FIG. 2 is a bottom view of an embodiment of the present invention.

The bottom plate 30 has a set of conductive clips 31 disposed thereon and configured to be corresponsive to the containing grooves 11 respectively, so that the conductive clips 31 can be installed from bottom to top and accommodated into the containing grooves 11, and the set of conductive clips 31 are coupled to a power cable 311 to electrically connect the mains power, and the bottom plate 30 has a set of notch plugs 32, and each abuts against an opening formed at the bottom of the through slot 122 and an engaging member 34 (such as a bolt) is passed through for a secured connection (as shown in FIG. 2), and an upwardly extended conductive plate 33 is installed between the two notch plugs 32, and a bottom section of the conductive plate 33 is bent and extended downwardly and inwardly from the bottom of the bottom plate 30 (as shown in FIG. 4), and jointly together with an end of a ground line 331 to the bottom of the bottom plate 30 by an engaging member 332 (such as a bolt) (as shown in FIG. 2).

Figure 5:
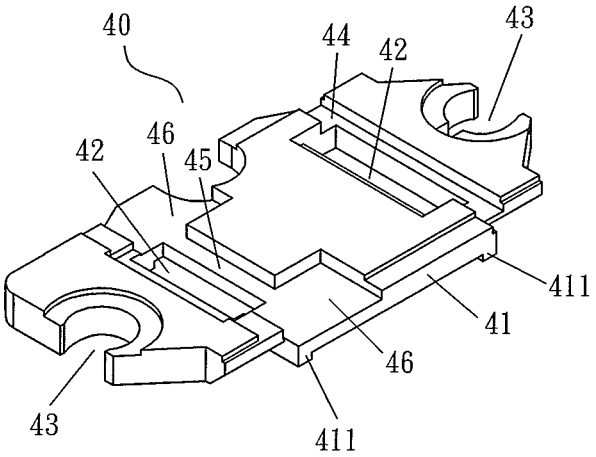
FIG. 5 is a perspective view of a safety element in accordance with an embodiment of the present invention.
Figure 6:
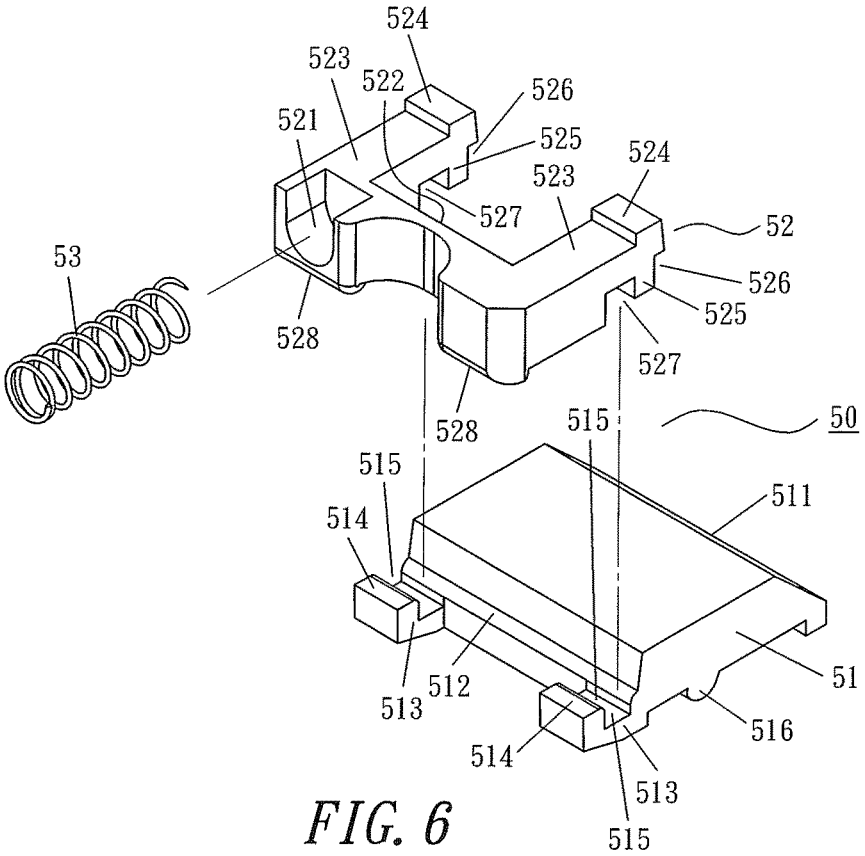
FIG. 6 is an exploded view of a protection door module in accordance with an embodiment of the present invention.

With reference to FIGS. 3, 4 and 5, the safety element 40 has a base surface 41, a standing pole 411 formed from each end of both ends of the bottom of the base surface 41, a through slot 42 vertically penetrated through each standing pole 411, a latch slot 43 formed on each end of the whole body, an acting groove 44, 45 formed at a position adjacent to each through slot 42, and a large recess 46 formed on each of both sides of the acting groove 45.

With reference to FIGS. 3, 4, 6 and 7 for the assembly of the safety protection door module 50, the safety protection door module 50 is comprised of a first protective plate 51, a second protective plate 52 and an elastic member 53, and the first protective plate 51 is a lump with a side defined as a pushing side 511 (as shown in FIG. 3) and the other side having a rib 512, and a link rod 513 is extended from each side and whose end is protruded upwardly to form a stopper 514, so that a containing groove 515 is formed between the rib 512 and the stopper 514, and another rib 516 is formed at the bottom of the first protective plate 51, and the second protective plate 52 is another lump, and an indentation 521 is formed on a side opposite to the first protective plate 51, a side coupled to the first protective plate 51 is defined as a pushing side 522 (as shown in FIG. 3), and a link rod 523 is extended from each edge, and whose end is protruded to form a stopper 524, and a top block 525 is formed at the bottom of each link rod 523, so that an outer end of the top block 525 becomes a recess 526 and an inner end of the top block 525 is a containing groove 527. In addition, a rib 528 is formed at a rear edge of the bottom of the second protective plate 52, and the elastic member 53 is preferably a long-strip spring.

Figure 7:
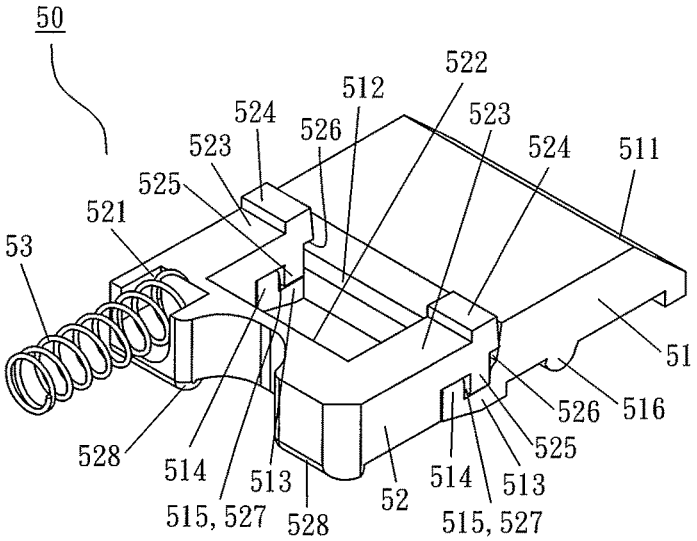
FIG. 7 is a perspective view of a protection door module in accordance with an embodiment of the present invention.

With reference to FIG. 7 for the assembly of the safety protection door module 50, the top block 525 of the second protective plate 52 is accommodated in the containing groove 515 of first protective plate 51, so that the recess 526 slightly touches the rib 512, while the stopper 514 of the first protective plate 51 is precisely accommodated in the containing groove 527 of the second protective plate 52, and then an end (an inner end) of the elastic member 53 is inserted and fixed into the indentation 521, so as to form the safety protection door module 50.

Figure 8:
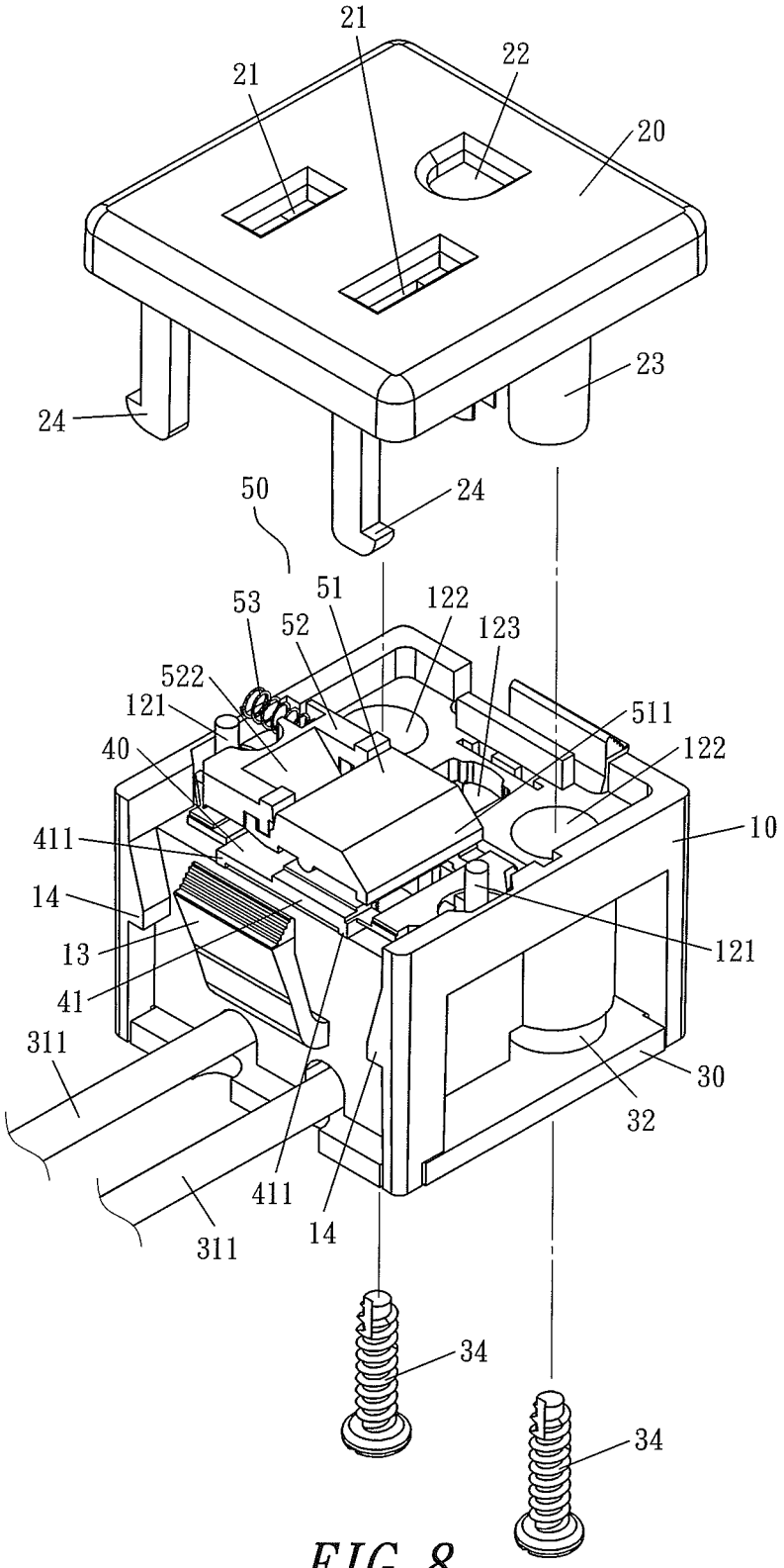
FIG. 8 is a partial perspective view of an embodiment of the present invention.
Figure 9:
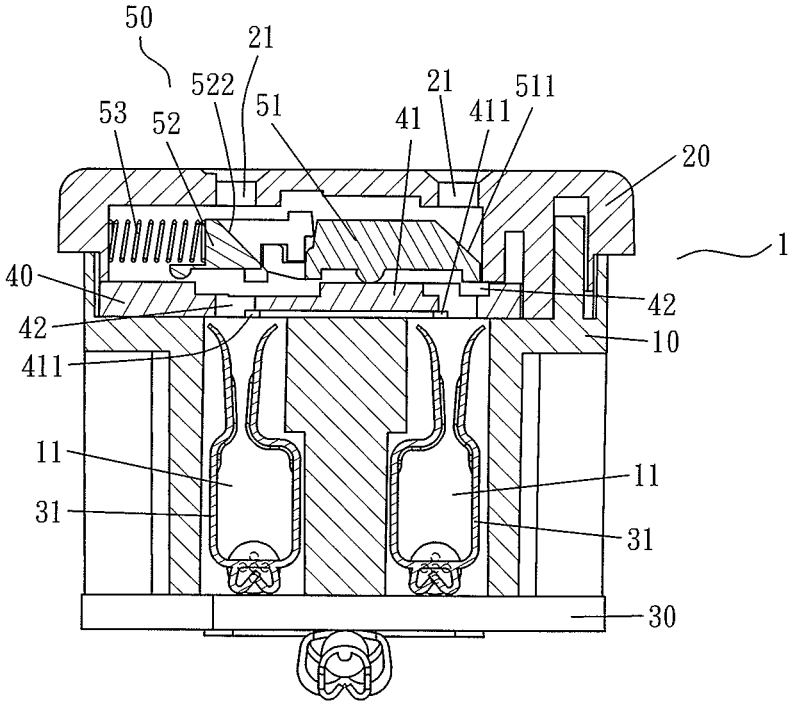
FIG. 9 is cross-sectional view of an embodiment of the present invention.

With reference to FIGS. 1, 2, 8, and 9 for the assembly of the whole socket 1, the bottom plate 30 together with the conductive clips 31, the notch plugs 32 and the conductive plates 33 are attached to the bottom of the casing 10, so that the two conductive clips 31 can enter and stay in the containing grooves 11 (as shown in FIG. 9), while the two notch plugs 32 are being plugged into the corresponsive lower notches of the through slots 122, and the conductive plate 33 can enter and stay in the through hole 123; and then the safety element 40 is placed horizontally in the first area of the roof 12 of the casing 10, wherein the standing pole 411 of the base surface 41 is erected from the roof 12, and the latch slots 43 at both ends latches a positioning rod 121, and the two through slots 42 are attached to a containing groove 11, and then the safety protection door module 50 is covered onto the safety element 40, so that the pushing side 511 of the first protective plate 51 and the pushing side 522 of the second protective plate 52 are disposed above the two through slots 42. As shown in FIG. 8, the panel 20 is finally covered onto the top of the casing 10, so that the two engaging pegs 23 enter into the through slots 122 respectively and the two latch rods 24 latch with the latching portions 14 respectively, and then two engaging members 34 (such as two bolts) are passed through a notch plug 32 and secured with the engaging pegs 23. After the assembling is completed, two electrically connected jacks 21 are configured to be corresponsive to two pushing sides 511, 522 respectively, and the ground jack 22 is configured to be corresponsive to the through hole 123. In the meantime, the rear end of the elastic member 53 in the safety protection door module 50 abuts precisely against an inner wall on a side of the panel 20 (as shown in FIG. 9) to provide a normal elastic effect, and the whole assembled socket 1 is shown in FIGS. 1 and 2.

Figure 10:
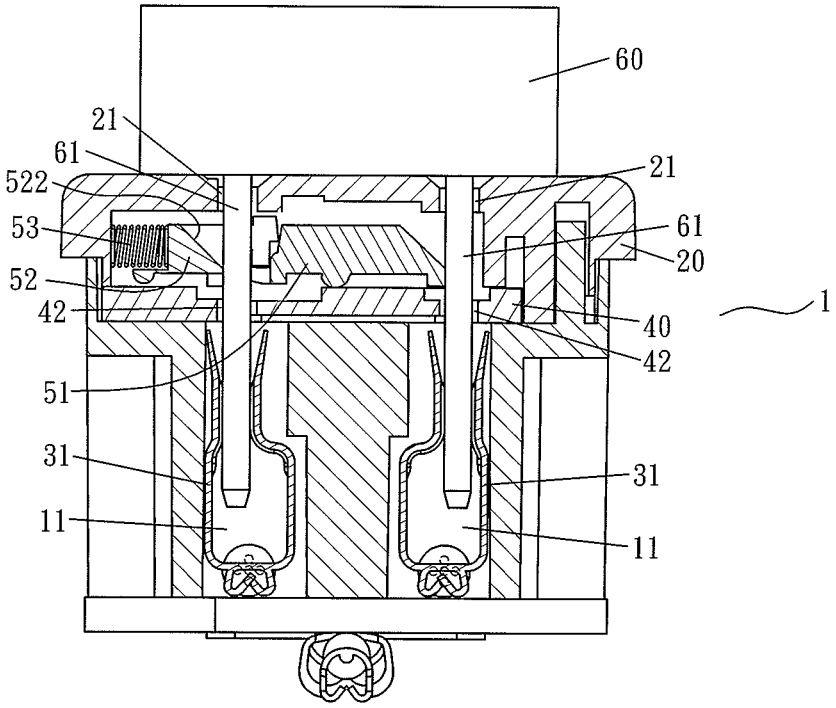
FIG. 10 is a cross-sectional view showing a correct use of an embodiment of the present invention.

The socket 1 may be in installed and accommodated into a reserved installation hole of a wall or a ceiling, and then a latch plate 13 coupled to the front and rear sides of the casing 10 is latched to the installation hole of the wall for the use of the socket 1. During a normal use of the socket 1 normal use as shown in FIG. 10, when at least two pins 61 of a plug 60 connected to a power cable of an electrical product are inserted into two electrically connected jacks 21 of the panel 20, the bottoms of the two pins 61 are touching the two pushing sides 511, 522, so that components of an insertion force push the first protective plate 51 and the second protective plate 52 to move in the direction of compressing the elastic member 53, and the two through slots 42 of the safety element 40 will not be covered, and the two pins 61 can be passed through the two through slots 42 successfully and inserted into the containing groove 11 and clamped by the conductive clips 31 to conduct the power to the two pins 61 of the electrical product. During use, the ground pin (if any) of the electrical product is inserted into the ground jack 22 of the panel 20, so that the through hole 123 is electrically conducted with the conductive plate 33.

Figure 11:
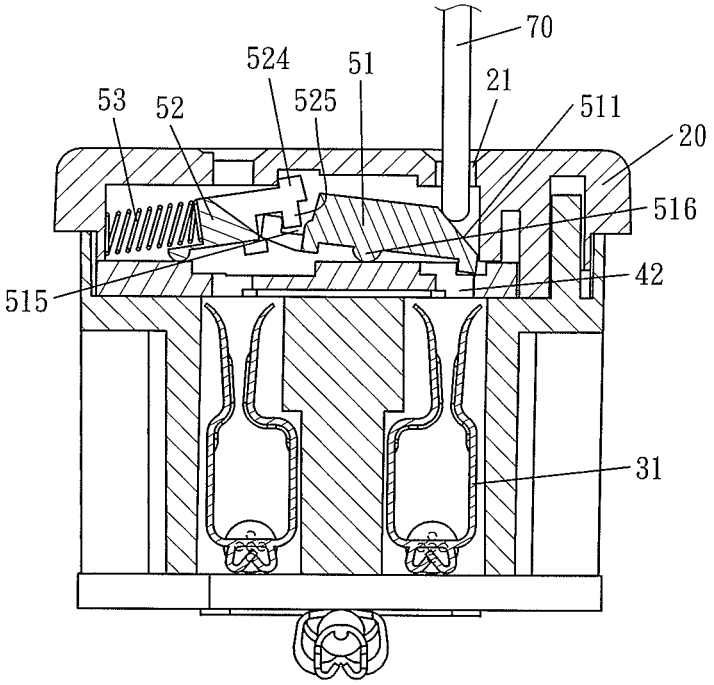
FIG. 11 is a cross-sectional view showing a wrong use of an embodiment of the present invention when providing a protection effect.
Figure 12:
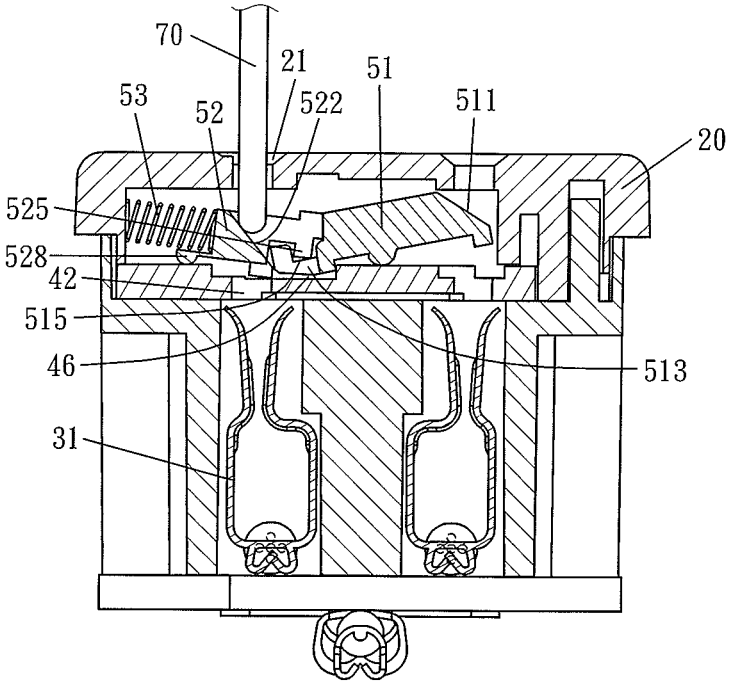
FIG. 12 is a cross-section view showing another wrong use of an embodiment of the present invention when providing a protection effect.

If a user intentionally or unintentionally inserts a strip member 70 into any one of the holes of the two electrically connected jacks 21 of the panel 20, two kinds of safety protection effects will be produced as shown in FIGS. 11 and 12 respectively, FIG. 11 shows that a user inserts a strip member 70 into one of the electrically connected jacks 21 (same as the situation of inserting into a single pin 61), so that when the strip member 70 touches the pushing side 511 of the first protective plate 51, components of the insertion force pushes the first protective plate 51 to move towards the second protective plate 5. Now, the second protective plate 52 is elastically blocked by the elastic member 53 and cannot retreat. As a result, the first protective plate 51 will be turned clockwise (in the direction as shown in FIG. 11) by using the rib 516 as the axis, and the containing groove 515 of the first protective plate 51 will push an end of the second protective plate 52 having on the stopper 524 and the top block 525 to be tilted. Since the pushing side 511 of the first protective plate 51 has not moved away, therefore the through slot 42 of the safety element 40 is still blocked, and the strip member 70 cannot move downward to touch the conductive clip 31, so as to prevent electrical shocks.

FIG. 12 shows that when the strip member 70 is inserted into another electrically connected jack 21 and the strip member 70 touches the pushing side 522 of the second protective plate 52, components of the insertion force push the second protective plate 52 to move towards the elastic member 53. Now, the pushing force is not exerted onto the first protective plate 51, so that the first protective plate 51 cannot be moved, and the second protective plate 52 will turn clockwise by using the rib 528 as the axis (in the direction as shown in FIG. 12). The top block 525 of the second protective plate 52 will push the containing groove 515 of the first protective plate 51 to sink. Now, the large recess 46 of the safety element 40 is provided for the link rod 513 of the first protective plate 51 to stay. Since the pushing side 522 of the second protective plate 52 has not moved away, therefore the through slot 42 of the safety element 40 is still blocked, and the strip member 70 cannot be moved downwardly to touch the conductive clip 31, so as to prevent electrical shocks.

In view of the description above, the present invention sets the safety element 40 horizontally in the first area of the roof 12 of the casing 10 and then covers the safety protection door module 50 onto the safety element 40, so that the pushing side 511 of the first protective plate 51 and the pushing side 522 of the second protective plate 52 in the safety protection door module are disposed above the two through slots 42 of the safety element 40 respectively, so that if a user intentionally or unintentionally inserts a strip member 70 into any one of the holes of the two electrically connected jacks 21 of the panel 20, the first protective plate 51 and the second protective plate 52 restrict one another and cover the through slot 42, and the strip member 70 will not touch the conductive clip 31, so as to prevent electrical shocks.

In summation of the above description, the present invention herein enhances the performance than the conventional structure and further complies with the patent application requirements and is duly filed for patent application. While the invention has been described by means of specific embodiments, numerous modifications and variations could be made thereto by those skilled in the art without departing from the scope and spirit of the invention set forth in the claims.

What is claimed is:

1. A socket with a safety protection effect, comprising a casing, a panel, a bottom plate, a safety element and a protection door module, characterized in that the casing comprises at least two containing grooves formed therein and vertically penetrated, and a first area and a second areas divided from a top panel at the top of the casing, and the first area is provided for the containing grooves to pass to the outside, and a second area has a through hole passing downwardly; the panel is covered onto the top of the casing and comprises two electrically connected jacks communicated with the containing grooves of the casing respectively, and a vertical engaging peg extended downwardly from the bottom of the panel into the through hole of the casing; the bottom plate has a set of conductive clips contained in the containing groove of the casing, and the set of conductive clips is coupled to a power cable connected to the mains power, and the bottom plate has a notch plug pluggable into an opening forming at the bottom of the through slot of the casing, and an engaging member passed through the notch plug and then engaged with the engaging peg of the panel; the safety element has a base surface, a standing pole formed separately at both ends of the bottom of the safety element, a through slot vertically penetrated through each standing pole, an acting groove formed adjacent to the through hole of the safety element, and a large recess formed separately on both sides of one of the acting grooves; and the safety protection door module is comprised of a first protective plate, a second protective plate and an elastic member, and the first protective plate is a lump with a side defined as a pushing side and the other side having a rib, and a link rod extended out from an edge, whose end protruded upwardly is a stopper, so that when a containing groove is formed between the rib and the stopper, the bottom of the first protective plate becomes a rib; the second protective plate is another lump with an indentation formed on a side opposite to the first protective plate, and a side coupled to the first protective plate is a pushing side, and a link rod is extended from each edge and whose end is protruded to form a stopper, and a top block is formed at the bottom of the link rods, so that an outer end of the top block becomes a recess and an inner end of the top block is a containing groove, and when the rear end of the bottom of the second protective plate is formed into a rib and assembled, the top block of the second protective plate is accommodated in the containing groove of the first protective plate, so that the recess of the second protective plate slightly touches the rib of the first protective plate, and the stopper of the first protective plate is accommodated in the containing groove of the second protective plate, and an end of the elastic member is inserted and fixed into the indentation of the first protective plate;

when the whole socket is assembled, the bottom plate together with the conductive clip and the notch plug are attached to the bottom of the casing, so that the conductive clip enters into the containing groove of the casing, while the notch plug is plugging a lower notch of the through slot of the casing lower notch, and then the safety element is erected from the first area of the roof of the casing by the standing pole of the base surface, so that the through slots of the safety element are attached to the containing grooves of the casing respectively, and then the safety protection door module is covered onto the safety element, so that the pushing side of the first protective plate and the pushing side of the second protective plate are disposed at the top of the through slot of the safety element, and finally the panel is covered onto the top of the casing, so that the rear end of the elastic member abuts against an inner wall on a side of the panel, while the engaging peg of the panel enters into the through slot of the casing, and then the engaging member is passed through the notch plug and engaged with the engaging peg.

2. The socket with a safety protection effect according to claim 1, further comprising a positioning rod erected from an outer side of the containing groove in the first area of the casing, and a latch slot formed on the safety element, and the latch slot latching the positioning rod when the safety element is erected from the first area of the casing.

3. The socket with a safety protection effect according to claim 1, wherein the casing has a through hole formed at the middle of the through slot, and the panel has a corresponsive ground jack, and the bottom plate has an upwardly extended conductive plate, and the bottom section of the conductive plate is bent and extended downwardly and inwardly from the bottom of the bottom plate, and then locked together with a ground line to the bottom of the bottom plate by an engaging member.

4. The socket with a safety protection effect according to claim 1, wherein the casing has a latch plate coupled to a side of the casing, so that when the socket is accommodated in a reserved installation hole, the latch plate coupled to a side of the casing side and the wall of the installation hole are latched.

5. The socket with a safety protection effect according to claim 1, wherein the casing has a latching portion formed on a side of the casing, and the panel has a corresponsive latch rod for latching the latching portion.

6. The socket with a safety protection effect according to claim 1, wherein the elastic member is preferably a long-strip spring.

* * * * *